US005323905A

United States Patent [19]

Gerondale et al.

[11] Patent Number: 5,323,905

[45] Date of Patent: Jun. 28, 1994

[54] PACKAGE FOR SURGICAL INSTRUMENTS

[75] Inventors: Scott J. Gerondale, Maineville; Edward A. Dales, Cincinnati, both of Ohio

[73] Assignee: Ethicon, Inc., Somerville, N.J.

[21] Appl. No.: 29,258

[22] Filed: Mar. 10, 1993

[51] Int. Cl.[5] ..... B65D 85/30; B65D 5/50

[52] U.S. Cl. ..... 206/461; 206/586; 206/594

[58] Field of Search ..... 206/586, 594, 591, 521, 206/453, 461, 45.14

[56] References Cited

U.S. PATENT DOCUMENTS

| | | | |
|---|---|---|---|
| 1,787,498 | 1/1931 | Tinsley | 206/594 |
| 3,324,999 | 6/1967 | Farquhar | 206/45.14 |
| 3,708,101 | 1/1973 | McDanield | 206/586 |
| 3,994,399 | 11/1976 | Nunata et al. | 206/586 |
| 4,583,639 | 4/1986 | Fedick et al. | 206/586 |
| 4,869,369 | 9/1989 | Turngren | 206/586 |
| 4,883,179 | 11/1989 | Dionne | 206/586 |

*Primary Examiner*—Paul T. Sewell
*Assistant Examiner*—Marie Denise Patterson
*Attorney, Agent, or Firm*—Emil Richard Skula

[57] ABSTRACT

An insert for an outer package for a thermoformed blister package, wherein the blister package has an outwardly extending flange. The foldable insert is placed within the outer package so that the flange of a blister package is rigidly supported and the outer package has improved stiffness and resistance to flexing. The insert has a pair of hingingly connected members having a rectangular cross-section. A longitudinal based panel having a pair of opposed major and a pair of opposed minor sides is foldably connected to a first end panel along the minor sides of the base panel. A first longitudinal side panel is foldably connected to a first major side of a longitudinal base panel and an opposed second longitudinal side panel is foldably connected to the other major side of the longitudinal base panel. A first longitudinal cover panel is foldably connected to the first longitudinal base panel and an opposed longitudinal side panel is foldably connected to the second longitudinal side panel. An end base panel having a pair of opposed major sides and a pair of opposed minor sides is hingingly connected along one minor side to one minor side of the longitudinal base panel. A first end side panel is foldably connected to a first major side of the end base panel and an opposed second end side panel is foldably connected to the other major side of the end base panel. A first end cover panel is foldably connected to the first end side panel and an opposed second end cover panel is foldably connected to the second end side panel. The ends of each side panel adjacent to the connecting minor ends of the longitudinal base panel and the end base panel are angulated.

5 Claims, 5 Drawing Sheets

100
110
120
122
122
125
30
30
24
20
22
28

PACKAGE FOR SURGICAL INSTRUMENTS

TECHNICAL FIELD

The field of art to which this invention relates is packaging, in particular, packages for surgical instruments.

BACKGROUND OF THE INVENTION

Endoscopic surgical instruments have been developed for use in endoscopic surgical procedures. The endoscopic surgical instruments, although rugged, must be properly packaged for sterilization and shipment and handling in order to prevent damage to the instruments. Many endoscopic surgical instruments are packaged in conventional thermoformed formed blister packages. The thermoformed blister packages are typically made to have a number of cavities which conform to the contours of particular surgical instruments. The surgical instruments are placed within these cavities and the cavities serve to both retain and cushion the instruments during sterilization, shipping and handling. Most thermoformed blister packages consist of a relatively rigid thermoformed lower tray and a flexible polymer cover which is typically gas permeable. A flange typically extends about the outer periphery of the blister tray to which the polymer top cover is sealed. The sealing may be accomplished by a number of conventional processes including ultrasonic welding, heat sealing and the use of various adhesives and bonding agents.

For shipment, handling and storage, it is necessary to place the blister packaged instrument into an outer package. The outer package serves several functions. It protects the blister package from inadvertent cuts, punctures and tears thereby preventing compromising of the sterility of the instrument. The package also serves to add a degree of additional protection to the blister package in the event of accidental drops or impacts.

It is especially critical in packaging a sealed, blister packaged, sterile instrument to protect the seal of the blister package. Although the blister tray is relatively rigid, it is still capable of flexing during shipping, handling and storage. This flexing is known to cause the flanges to twist thereby potentially causing the cover seal to delaminate in those areas where the twisting or torsional forces are extreme. In order to prevent this type of flexing, it is necessary to somehow support the flanges of the blister package when it is inserted into an outer package. Present approaches utilize massive amounts of polymeric foams, such as polyurethane foam, to cushion and protect the packages. There are various disadvantages associated with polymeric foam. One disadvantage is that in order for the foam to be effective, a relatively large quantity of the foam is required thereby increasing the size of an outer box into which the blister packed instrument is packaged Another disadvantage of the polymeric foams is the fact that they are difficult to dispose of and recycle. Yet another disadvantage is that the larger boxes required for a foam packed blister package take up additional shelf space in a hospital supply storage area.

Therefore, it is an object of the present invention to provide a package for a thermoformed blister packaged endoscopic instrument which supports the flanges of the blister packages without the need for a polymeric foam outer cushion.

It is a further object of the present invention to provide a package which supports the flange of a blister package thereby minimizing twisting and flexing of the flange of the blister package and additionally minimizing the possibility of a seal delaminating.

It is yet a further object of the present invention to provide a package for a blister package which has improved stiffness.

SUMMARY OF THE INVENTION

Accordingly, a package for a thermoformed, blister package having an outwardly extending flange is disclosed The package comprises an outer package, and at least one foldable insert having a rectangular cross-section. The foldable insert is placed within the package so that the flange of a blister package is rigidly supported and so that the package has improved stiffness and resistance to flexing. The insert comprises a pair of hingingly connected members having a rectangular cross-section. The insert may comprise a longitudinal base panel having a pair of opposed major sides and a pair of opposed minor sides. A first longitudinal side panel is foldably connected to a first major side of the longitudinal base panel and an opposed second longitudinal side panel is foldably connected to the other major side of the longitudinal base panel. A first longitudinal cover panel is foldably connected to the first longitudinal side panel and an opposed second longitudinal cover panel is foldably connected to the second longitudinal side panel. An end base panel is hingingly connected along a minor side to one minor side of the longitudinal base panel, the end base panel having a pair or opposed major sides and a pair of opposed minor sides. A first end side panel is foldably connected to a first major side of the end base panel and an opposed second end side panel is foldably connected to the other major side of the end base panel. A first end cover panel is foldably connected to the first end side panel and an opposed second end cover panel is foldably connected to the second end side panel. The ends of each side panel adjacent to the connected minor ends of the longitudinal base panel and the end base panel are angulated. In a preferred embodiment two inserts are used to support the entire flange of a blister package. In an alternate embodiment the two inserts are hingingly connected.

Yet another aspect of the present invention is the above-described insert.

Other features and advantages of the invention will become more apparent from the following description and accompanying drawings.

BEST MODE FOR CARRYING OUT THE INVENTION

Figure 1:
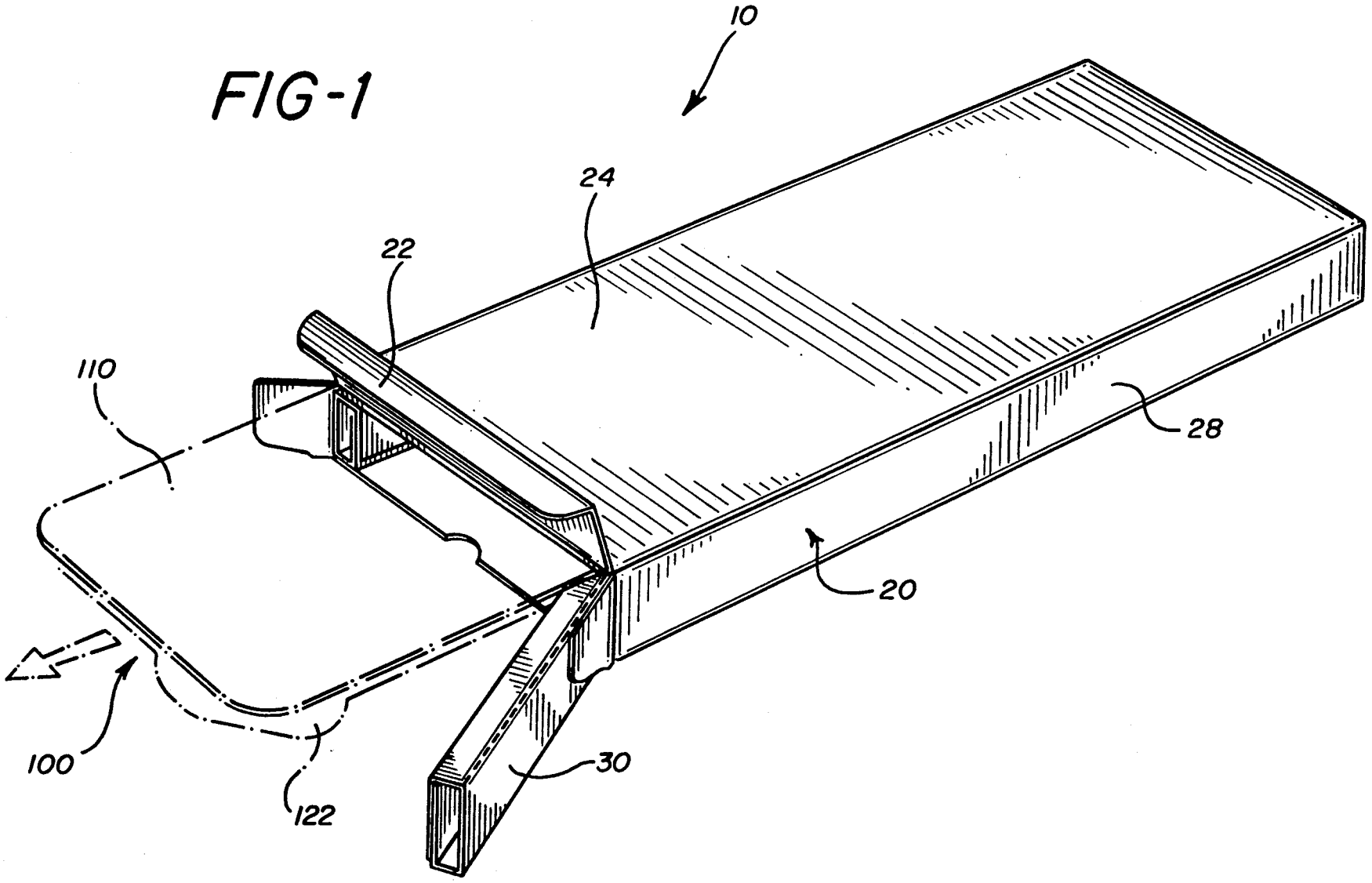
FIG. 1 is a perspective view of a package of the present invention containing a thermoformed blister package and further having the insert of the present invention supporting a flange of the blister package.
Figure 2:
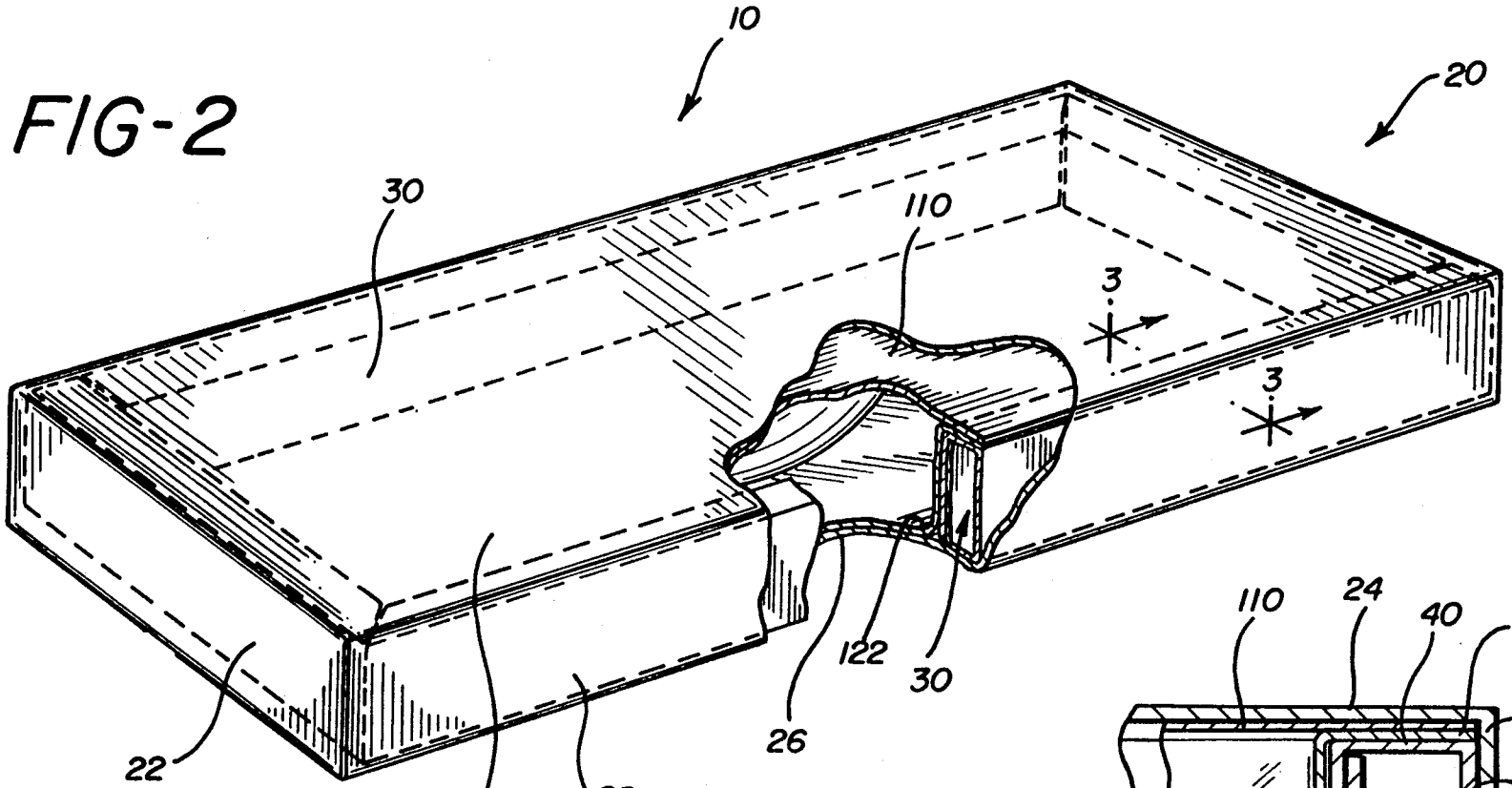
FIG. 2 is a perspective view of the package of the present invention having a partial cut-away illustrating the insert of the present invention contained within the package and supporting the flange of a thermoformed blister package.
Figure 3:
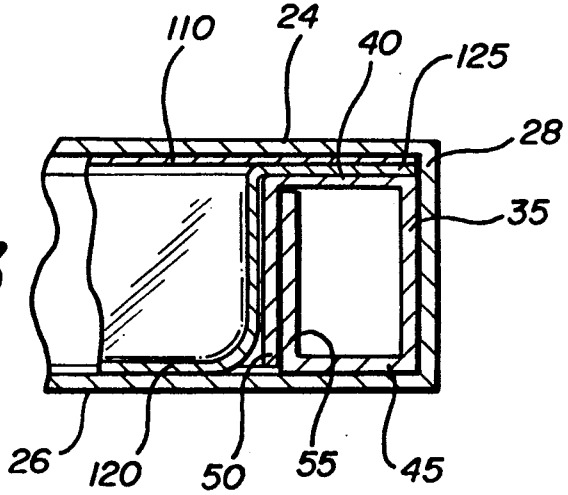
FIG. 3 is a partial cut-away of the package of FIG. 2 along line 3—3, illustrating the rectangular cross-section of the insert.
Figure 4:
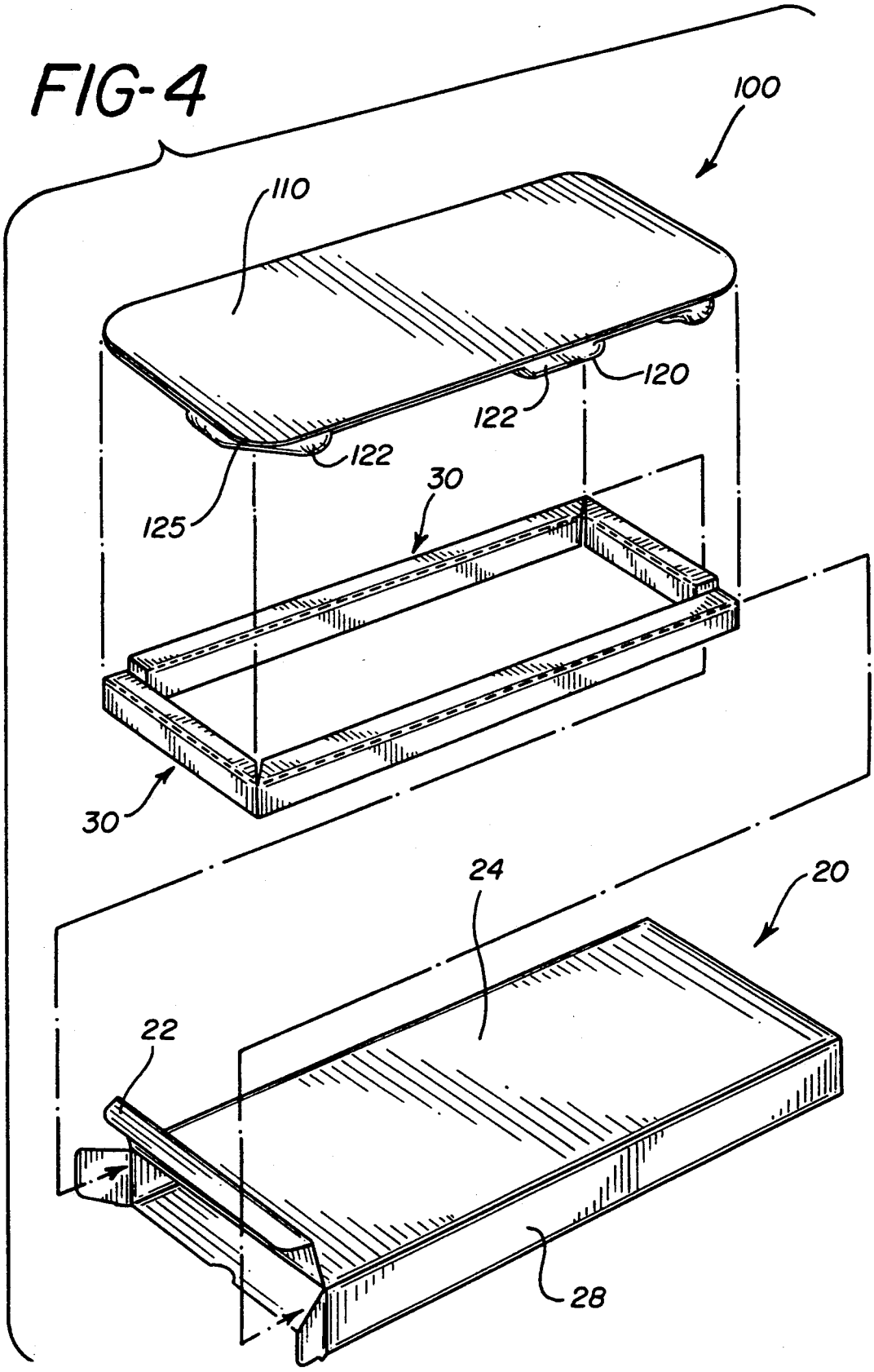
FIG. 4 is an exploded perspective view of a package of the present invention illustrating the insert of the present invention.
Figure 5:
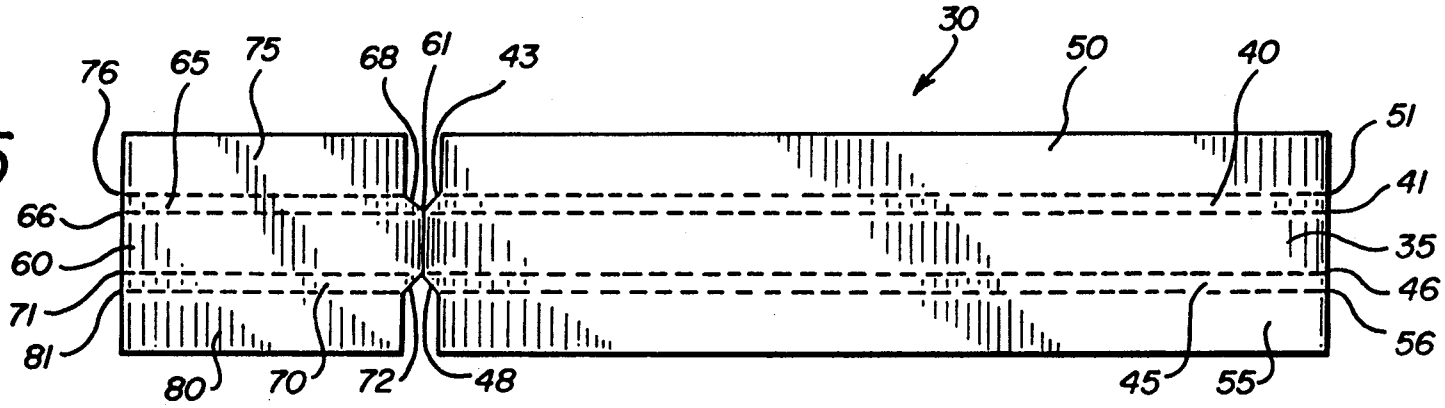
FIG. 5 is a plan view of the insert of the present invention prior to folding.
Figure 6:
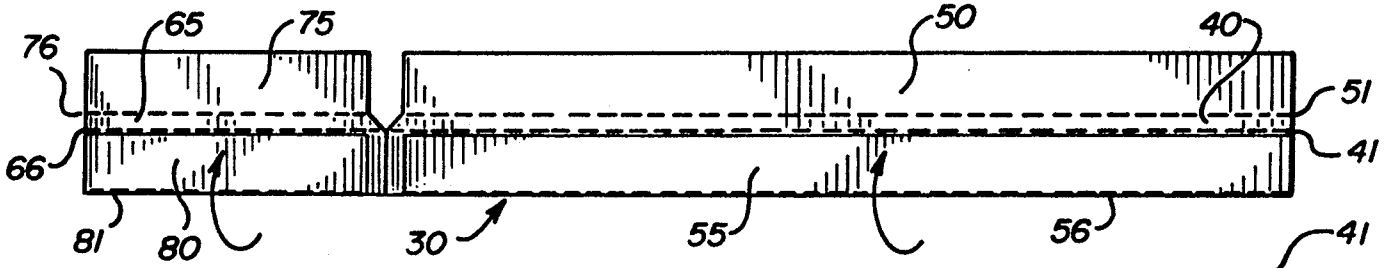
FIG. 6 is a plan view of the insert of the present invention partially folded.
Figure 7:
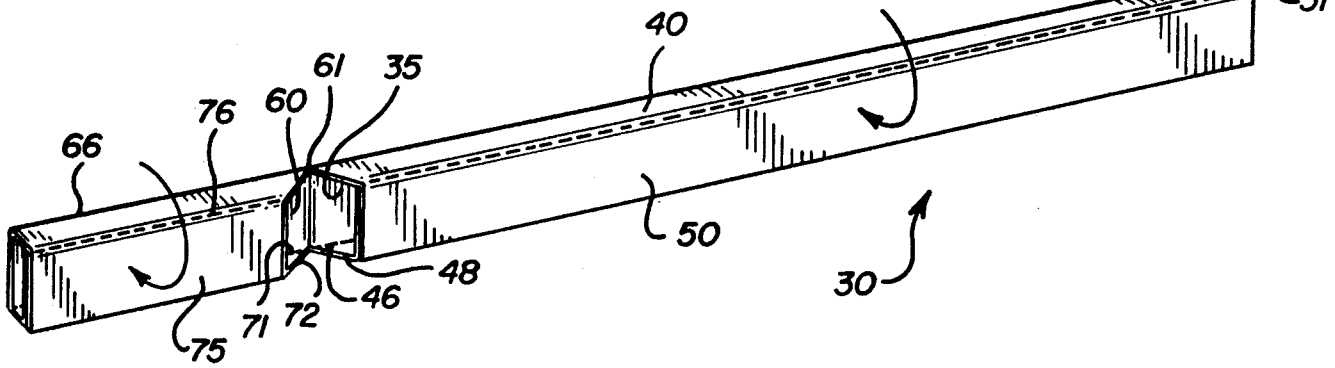
FIG. 7 is a perspective view of the insert of the present invention folded prior to folding about the hinged connection between the longitudinal base panel and the end base panel.

The package 10 of the present invention is illustrated in FIG. 1 and FIG. 4. Referring also to FIGS. 2 and 3, package 10 to seen to have outer package 20 and insert 30. Thermoformed blister package 100 is seen to have lower tray 120 and upper cover 110. Extending from the top of tray 120 is the outwardly extending flange 125. The top cover 110 is sealed to the flange 125 of tray 120 to produce seal 105. The sealing process utilized may be any conventional process used to seal covers to blister trays including ultrasonic, adhesives, bonding agents, etc. An instrument is typically contained within the cavities 122 of the tray 120.

Tray 120 is typically constructed from conventional thermoformed material such as PVC, Polystyrene, and T Polymer (acrylic resin). The blister tray 120 is manufactured using conventional thermoforming equipment and conventional thermoforming processes. The cover 110 is made of conventional materials including paper, polymers, and Tyvek®. The top cover 110 is bonded to flange 125 of tray 110 to form seal 105 using conventional methods such as ultrasonic bonding, heat sealing, adhesives and the like.

The outer package 20 may be any conventional outer package or container, e.g., a box having a top panel 24, bottom panel 26 and side panels 28 as well as end closure flaps 22. The package 20 is made from any conventional packaging materials including fiber board, paper, plastics, composites and the like having sufficient rigidity to effectively function in a package.

Referring now to FIGS. 5–8, the insert 30 is seen to have a longitudinal base panel 35 having a pair of opposed major sides and a pair of opposed minor sides. A first longitudinal side panel 40 is foldably connected to a first major side of the longitudinal base panel 35 along fold line 41. A second opposed longitudinal side panel 45 is seen to be foldably connected to longitudinal base panel 35 along fold line 46. A first longitudinal cover panel 50 is seen to be foldably connected to the first longitudinal side panel 40 along fold line 51. A second opposed longitudinal cover panel 55 is connected to the second longitudinal side panel 45 along fold line 56. End base panel 60 is seen to be hingingly connected to longitudinal base panel 35 along hinge 61. The hinge 61 may be a fold line or other conventional hinge, including flexible tape, which allows the end base panel 60 to move or point with respect to the longitudinal base panel 35.

End base panel 60 is seen to have a pair of opposed major sides and a pair of opposed minor sides. A first side end panel 65 is seen to be foldably connected to a first major side of the end base panel 60 along fold line 66. An opposed second side panel 70 is seen to be foldably connected to the other major side of the end base panel along fold line 71. A first end cover panel 75 is seen to be foldably connected to the first end side panel 75 along fold line 76. An opposed second end cover panel 80 is seen to be foldably connected to the second end side panel 70 along fold line 81. The end 68 of first side end panel 65 and the end 72 of second side end panel 70 are each angulated adjacent to hinge 61. Similarly, the end 43 of first longitudinal side panel 40 and the end 48 of second longitudinal side panel 45 are each angulated adjacent to the hinge 61.

Referring to FIGS. 5–8, the insert 30 is assembled in the following manner. Initially, second longitudinal side panel 45 is folded upwardly along fold line 46 so that the panel 45 is perpendicular to the longitudinal base panel 35. Then, second longitudinal cover panel 55 is folded upwardly about fold line 56 so that panel 55 is substantially parallel to longitudinal base panel 35. Similarly, second end side panel 70 is folded upwardly about fold line 71, and second end cover panel 80 is folded upwardly about fold line 81 so that end panel 70 is substantially perpendicular to the end base panel 60 and second end cover panel 80 is substantially parallel to end base panel 60. Then, first longitudinal side panel 40 is folded inwardly about fold line 41 to a position wherein it is substantially perpendicular to the base panel 35. Next, first longitudinal cover panel 50 is folded inwardly about the fold line 51 and over second longitudinal cover panel 55 so that the second cover panel 55 is substantially parallel to base panel 35 and second cover panel 55. Then, first end side panel 65 is folded inwardly about fold line 66 so that panel 65 is substantially perpendicular to end base panel 60, and, the first end cover panel 75 is similarly folded inwardly about fold line 76 so that the panel 75 covers the cover panel 80 and is substantially parallel to the end base panel 60 and cover panel 80.

Figure 8:
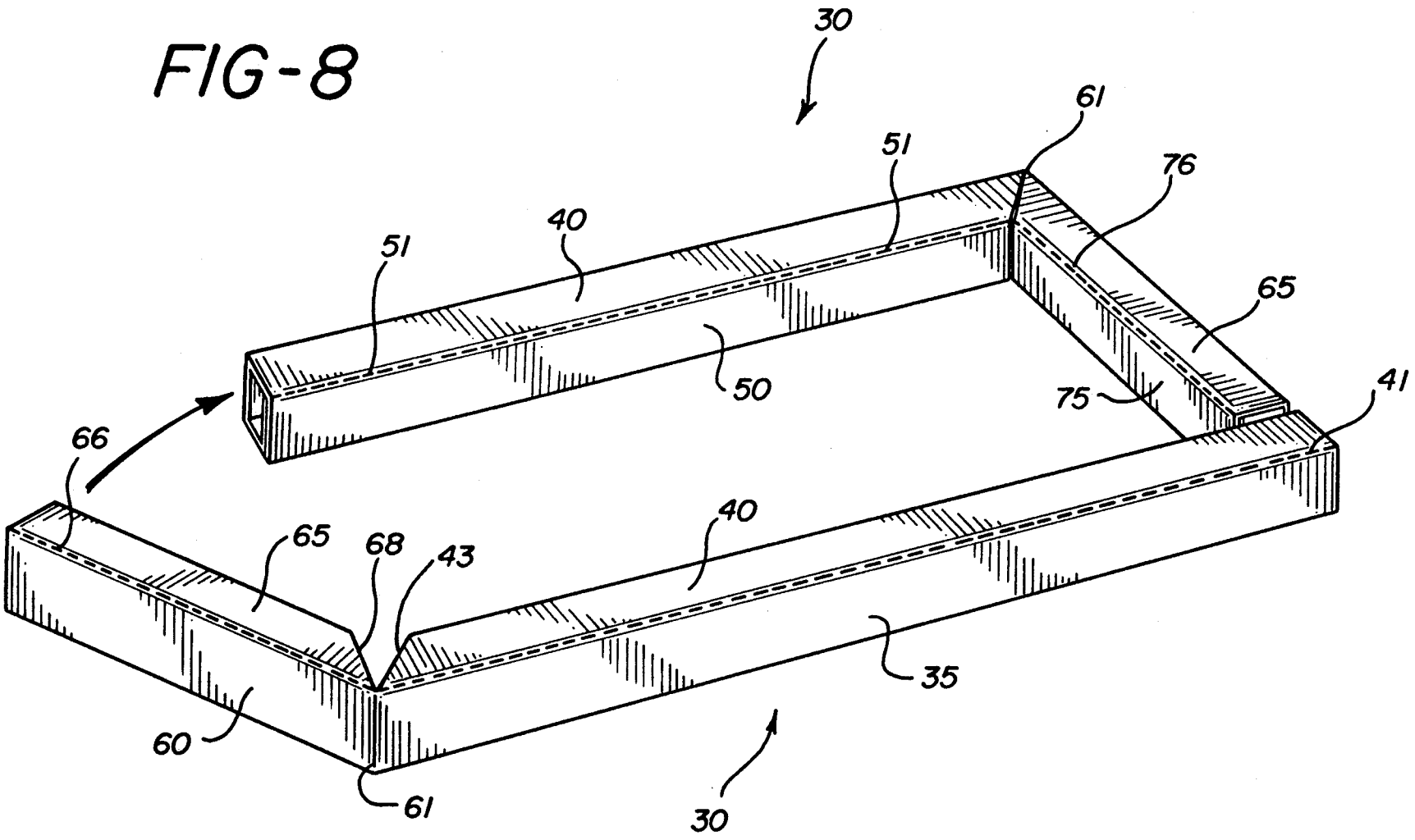
FIG. 8 is a perspective view of two inserts of the present invention as they would be configured in a package.

The insert 30 when assembled is seen to have a substantially rectangular cross-section. The final step of the assembly of the insert 30, as seen in FIG. 8, is to fold the section having longitudinal base panel 35 toward the section having end base panel 60 about hinge line 61 (or vice versa) such that angled section 43 of longitudinal side panel 40 touches, or is in proximity to angled section 68 of first end side panel 65 and similarly, angled section 48 of side panel 45 is in close proximity or touching angled section 72 of side panel 70.

A sealed blister package 100 containing an endoscopic instrument is packaged within package 10 by first inserting one assembled insert 30 into the package 20 such that the end base panel 60 is parallel to the end of the package 20 and the longitudinal base panel 35 is parallel to the side of the package 20. Next, the package 100 is inserted into the package 20 such that the insert 30 supports the flange 125 along two adjoining sides of the tray 120, i.e., along an end side and a longitudinal side. Next, the second insert 30 is inserted into the package 20 and underneath the remaining sides of the flange 125. Then the package 20 is closed typically by securing an end flap 22. The package 10 is easily opened by opening an end flap 22 of package 20 and swinging out the section of insert 30 which is parallel to the end flap 22. The package 100 is then easily removed from the outer package 20.

The insert 30 of the present invention is preferably made of conventional packaging materials such as solid bleached sulphate, clay coated fiberboard or other similar fiberboard materials. The materials will be sufficiently stiff to effectively provide structural rigidity.

The insert 30 will typically be manufactured by conventional methods such as dye cutting, scarring, and gluing. The formed insert 30 will have a sufficient height and a sufficient width to effectively support the flange 125 of ray 120 when the package 100 is placed within package 20.

The inserts 30 have many advantages. The insert 30 is relatively inexpensive and easy to manufacture from recyclable materials. The use of the insert 30 provides support for the flange 125 of a blister packaged instrument 100 and serves to stiffen a package 20 to resist flexion or torsion during handling, shipping, storage and sterilization, thereby helping to protect the seal 125 from damage. The use of the inserts 30 can eliminate the need for foam cushioning and oversize outer packages.

Although this invention has been shown and described with respect to detailed embodiments thereof, it will be understood by those skilled in the art that various changes in form and detail thereof may be made without departing from the spirit and scope of the claimed invention.

What is claimed is:

1. A package for a blister package wherein the blister package has an outwardly extending flange, the package comprising:

an outer package; and, at least one foldable insert having a rectangular cross-section, said insert comprising:

a longitudinal base panel having a pair of opposed major sides and a pair of opposed minor sides;

a first longitudinal side panel foldably connected to a first major side of the longitudinal base panel and an opposed second longitudinal side panel foldably connected to the other major side of the longitudinal base panel;

a first longitudinal cover panel foldably connected to the first longitudinal side panel and an opposed second longitudinal cover panel foldably connected to the second longitudinal side panel;

an end base panel hingingly connected to one minor side of the longitudinal base panel, the end base panel having a pair of opposed major sides and a pair of opposed minor sides;

a first end side panel foldably connected to a first major side of the end base panel and an opposed second end side panel foldably connected to the other major side of the end base panel;

a first end cover panel foldably connected to the first end side panel, and an opposed second end cover panel foldably connected to the second end side panel, wherein the ends of each side panel adjacent to the connected minor ends of the longitudinal base panel and the end base panel are angulated and wherein the insert is placed within said outer package said insert capable of rigidly supporting a flange of a blister package inserted into the package.

2. The package of claim 1 wherein the insert comprises a pair of hingingly connected members having a rectangular cross-section.

3. The package of claim 1 further comprising at least two inserts.

4. A foldable insert for a package comprising:

a longitudinal base panel having a pair of opposed major sides and a pair of opposed minor sides;

a first longitudinal side panel foldably connected to a first major side of the longitudinal base panel and an opposed second longitudinal side panel foldably connected to the other major side of the longitudinal base panel;

a first longitudinal cover panel foldably connected to the first longitudinal side panel and an opposed second longitudinal cover panel foldably connected to the second longitudinal side panel;

an end base hingingly connected to one minor side of the longitudinal base panel, the end base panel having a pair of opposed major sides and a pair of opposed minor sides;

a first end side panel foldably connected to a first major side of the end base panel and an opposed second end side panel foldably connected to the other major side of the end base panel;

a first end cover panel foldably connected to the first end side panel, and an opposed second end cover panel foldably connected to the second end side panel, wherein the ends of each side panel adjacent to the connected minor ends of the longitudinal base panel and the end base panel are angulated.

5. The combination comprising;

an outer package;

a thermoformed blister package having a top and a bottom, the blister package having an outwardly extending flange about the top and a top cover sealed to the flange; and, an insert for supporting the flange when the blister package is contained within the outer package, the insert comprising:

a longitudinal base panel having a pair of opposed major sides and a pair of opposed minor sides;

a first longitudinal side panel foldably connected to a first major side of the longitudinal base panel and an opposed second longitudinal side panel foldably connected to the other major side of the longitudinal base panel;

a first longitudinal cover panel foldably connected to the first longitudinal cover panel foldably connected to the second longitudinal side panel;

an end base panel hingingly connected to one minor side of the longitudinal base panel, the end base panel having a pair of opposed major sides and a pair of opposed minor sides;

a first end side panel foldably connected to a first major side of the end base panel and an opposed second end side panel foldably connected to the other major side of the end base panel;

a first end cover panel foldably connected to the first end side panel, and an opposed second end cover panel foldably connected to the second end side panel, wherein the ends of each side panel adjacent to the connected minor ends of the longitudinal base panel and the end base panel are angulated.

* * * * *